US010435765B2

(12) United States Patent
Hirakami et al.

(10) Patent No.: US 10,435,765 B2
(45) Date of Patent: Oct. 8, 2019

(54) WIRE ROD FOR HIGH STRENGTH STEEL CORD

(71) Applicant: NIPPON STEEL & SUMITOMO METAL CORPORATION, Tokyo (JP)

(72) Inventors: Daisuke Hirakami, Kisarazu (JP); Makoto Okonogi, Chiba (JP)

(73) Assignee: NIPPON STEEL CORPORATION, Tokyo (JP)

( * ) Notice: Subject to any disclaimer, the term of this patent is extended or adjusted under 35 U.S.C. 154(b) by 388 days.

(21) Appl. No.: 15/305,295

(22) PCT Filed: Apr. 23, 2015

(86) PCT No.: PCT/JP2015/062367
§ 371 (c)(1),
(2) Date: Oct. 19, 2016

(87) PCT Pub. No.: WO2015/163407
PCT Pub. Date: Oct. 29, 2015

(65) Prior Publication Data

US 2017/0037491 A1 Feb. 9, 2017

(30) Foreign Application Priority Data

Apr. 24, 2014 (JP) ..... 2014-090601

(51) Int. Cl.
*C21D 9/52* (2006.01)
*C21D 8/06* (2006.01)
(Continued)

(52) U.S. Cl.
CPC ..... *C21D 9/52* (2013.01); *C21D 8/065* (2013.01); *C22C 38/00* (2013.01); *C22C 38/001* (2013.01);
(Continued)

(58) Field of Classification Search
None
See application file for complete search history.

(56) References Cited

U.S. PATENT DOCUMENTS 10,156,001 B2 * 12/2018 Hirakami ..... C21D 8/065
2009/0007998 A1 * 1/2009 Kochi ..... C21D 8/065 148/598
(Continued)

FOREIGN PATENT DOCUMENTS

CN 101208445 A 6/2008
EP 2687619 A1 1/2014
(Continued)

OTHER PUBLICATIONS

English translation of JP 2001/220649, Aug. 2001; 13 pages.*
(Continued)

*Primary Examiner* — Helene Klemanski
(74) *Attorney, Agent, or Firm* — Birch, Stewart, Kolasch & Birch, LLP

(57) ABSTRACT

A wire rod for a steel cord has a wire diameter R of 3.5 mm to 8.0 mm, and includes, in a chemical composition, by mass %: C: 0.70% to 1.20%; Si: 0.15% to 0.60%; Mn: 0.10% to 1.00%; N: 0.0010% to 0.0050%; Al: more than 0% and 0.0100% or less; and a remainder of Fe and impurities, in which a surface part and a central part are included, a thickness of the surface part is 50 μm to 0.20×R, the central part includes a pearlite structure in a proportion of 95% to 100% by area %, a C content of the surface part is 40% to 95% of a C content of the central part, and a ratio of a thickness of a lamellar cementite at a center of the thickness of the surface part to a thickness of a lamellar cementite in the central part is 95% or less, whereby high strength and workability can be achieved even after a finish drawing
(Continued)

process and cracking or the like caused by a delamination phenomenon can be prevented.

2 Claims, 4 Drawing Sheets

(51) Int. Cl.

| | |
|---|---|
| ***C22C 38/02*** | (2006.01) |
| ***C22C 38/04*** | (2006.01) |
| ***C22C 38/06*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/30*** | (2006.01) |
| ***C22C 38/32*** | (2006.01) |
| ***C22C 38/00*** | (2006.01) |

(52) U.S. Cl.

CPC ..... *C22C 38/002* (2013.01); *C22C 38/005* (2013.01); *C22C 38/02* (2013.01); *C22C 38/04* (2013.01); *C22C 38/06* (2013.01); *C22C 38/22* (2013.01); *C22C 38/24* (2013.01); *C22C 38/26* (2013.01); *C22C 38/28* (2013.01); *C22C 38/30* (2013.01); *C22C 38/32* (2013.01); *C21D 8/06* (2013.01); *C21D 2211/003* (2013.01); *C21D 2211/009* (2013.01)

(56) References Cited

U.S. PATENT DOCUMENTS

| | | | | |
|---|---|---|---|---|
| 2009/0151824 | A1* | 6/2009 | Yamasaki | C21D 8/065 148/598 |
| 2011/0168302 | A1 | 7/2011 | Takahashi et al. | |
| 2012/0014831 | A1 | 1/2012 | Yamasaki et al. | |
| 2012/0318410 | A1* | 12/2012 | Tarui | C22C 38/02 148/506 |
| 2013/0263975 | A1* | 10/2013 | Yamasaki | C21D 9/52 148/505 |
| 2014/0000767 | A1 | 1/2014 | Yamasaki et al. | |
| 2016/0145712 | A1* | 5/2016 | Okonogi | C22C 38/06 148/598 |
| 2017/0044642 | A1* | 2/2017 | Hirakami | C21D 8/065 |
| 2018/0216213 | A1* | 8/2018 | Okonogi | C21D 8/065 |

FOREIGN PATENT DOCUMENTS

| | | | | |
|---|---|---|---|---|
| EP | 3 015 563 | A1 | | 5/2016 |
| JP | 2000-119805 | A | | 4/2000 |
| JP | 2001-181793 | A | | 7/2001 |
| JP | 2001/220649 | A | * | 8/2001 |
| JP | 2003/334606 | A | * | 11/2003 |
| JP | 2004-91912 | A | | 3/2004 |
| JP | 2005-36356 | A | | 2/2005 |
| JP | 2005-54260 | A | | 3/2005 |
| JP | 2010-270391 | A | | 12/2010 |
| JP | 2011-219829 | A | | 11/2011 |
| JP | 2012-126954 | A | | 7/2012 |
| KR | 10-2011-0020256 | A | | 3/2011 |
| KR | 10-2013-0034029 | A | | 4/2013 |
| WO | WO 2011/089782 | A1 | | 7/2011 |
| WO | WO 2014/208492 | A1 | | 12/2014 |
| WO | WO 2015/163409 | A1 | | 10/2015 |

OTHER PUBLICATIONS

English translation of JP 2003/334606, Nov. 2003; 10 pages.*

Korean Notice of Allowance, dated Mar. 21, 2018, for corresponding Korean Application No. 10-2016-7029609, with an English translation.

Chinese Office Action and Search Report, dated Sep. 25, 2017, for counterpart Chinese Application No. 201580020662.8, with an English translation of the Search Report.

Extended European Search Report, dated Sep. 6, 2017, for counterpart European Application No. 15783324.5.

International Search Report for PCT/JP2015/062367 (PCT/ISA/210) dated Jun. 2, 2015.

Written Opinion of the International Searching Authority for PCT/JP2015/062367 (PCT/ISA/237) dated Jun. 2, 2015.

Japanese Office Action dated Jun. 27, 2017, for Japanese Application No. 2016-515198, with partial English translation.

* cited by examiner

WIRE ROD FOR HIGH STRENGTH STEEL CORD

TECHNICAL FIELD OF THE INVENTION

The present invention relates to a wire rod for a high strength steel cord, which is used as a reinforcing material of a rubber product such as a tire for a vehicle, a high pressure rubber hose, or a conveyor belt.

Priority is claimed on Japanese Patent Application No. 2014-090601, filed on Apr. 24, 2014, the content of which is incorporated herein by reference.

RELATED ART

For example, for a rubber product such as a tire for a vehicle; chemical fibers made of rayon, nylon, polyester, or the like; or steel cords produced from a wire rod may be used as a reinforcing material. Such a reinforcing material is used for the frame of a tire for a vehicle and has a significant effect on the fuel efficiency, high speed durability, and steering stability of the vehicle in which the tire for a vehicle is mounted. In recent years, from the viewpoint of improving these characteristics, the frequency of use of steel cords as the reinforcing material has increased.

Here, for example, as disclosed in Patent Documents 6 and 7, a steel cord having a twisted structure made by twisting a plurality of steel wires (hereinafter, referred to as "filaments") has been widely proposed.

The steel cord using these filaments is produced through the following process.

First, dry drawing is performed on a wire rod having a wire diameter of 3.5 mm to 8.0 mm to produce a steel wire having a wire diameter of about 1.0 mm to 4.0 mm, and a heat treatment called a patenting treatment is performed on the steel wire to soften the steel wire.

Next, a brass plating is formed on the surface of the softened steel wire to ensure the adhesion between rubber and the steel cord, and the resultant is subjected to wet drawing (finish drawing), thereby forming filaments having a wire diameter of 0.15 mm to 0.35 mm.

The filaments obtained as described above are twisted to produce a steel cord having a twisted structure.

In recent years, from the viewpoint of a reduction in environmental load, tires for vehicles have been reduced in weight in order to promote fuel economy in vehicles, and high-strengthening is required in the steel cord. Therefore, high-strengthening is required in the wire rod for the steel cord as a material.

In order to form a high strength steel cord, high-strengthening is necessary after the patenting treatment, and high-strengthening is achieved through composition adjustment, such as increasing the C content.

However, when high-strengthening is performed only through composition adjustment by increasing the C content, the ductility is insufficient during drawing after patenting, and thus workability deteriorates. Therefore, during wet drawing (finish drawing) and twisting, defects such as cracks are generated.

Patent Document 1 discloses, for the purpose of inexpensively providing a high carbon steel wire rod having excellent drawability, in which wire breaking does not occur even when drawing is performed with a true strain amount of more than 2.60, and which is thus appropriate for use in a steel cord or the like, a wire rod in which the average value of C content in a region from the outer circumference to a position at a depth of 1/50 of the radius of the steel wire rod in a transverse section of a steel wire rod is 0.6×C % to 0.9×C % of the C content of the wire rod.

Patent Document 2 discloses, for the purpose of providing a wire rod which is less likely to cause wire breaking caused by flaws due to handling or the like during transportation, a high strength directly patented wire rod having a diameter of 4.0 mm to 16 mm, in which the carbon content of a layer at a depth of 300 μm from the surface layer is 0.97 times or less of the average carbon content of the entire cross section, and the surface layer having an average lamellar spacing of 95 nm or more in the above-mentioned layer is the layer where chafing martensite is less likely to be formed.

Patent Document 3 discloses, for the purpose of providing a wire rod which has excellent cold workability and is thus appropriate as a production material of a steel cord or the like, a wire rod in which the size of pearlite blocks is controlled to be austenite grain size numbers 6 to 8 in the steel, the amount of generated proeutectoid cementite is controlled to be 0.2% or less by volume fraction, the thickness of cementite in pearlite is controlled to be 20 nm or less, and the Cr content of the cementite is controlled to be 1.5% or less.

Patent Document 4 discloses a high carbon steel wire rod for drawing, in which, when the diameter of the high carbon steel wire rod is referred to as D, a region ranging from the surface of the high carbon steel wire rod to a depth of 0.05 D or less is referred to as a surface part, a region deeper than 0.20 D from the surface is referred to as an inside part, 90% or more of the structure of the surface part is a coarse lamellar pearlite structure having a lamellar spacing of 0.10 μm or more, and 95% or more of the structure of the inside part is a fine pearlite structure or a degenerate-pearlite structure having a lamellar spacing of less than 0.10 μm.

Patent Document 5 discloses a high carbon steel wire rod in which the area fraction of pearlite in a cross-section perpendicular to a longitudinal direction is 95% or more, the remainder therein has a non-pearlite structure including one or more of bainite, degenerate-pearlite, proeutectoid ferrite, and proeutectoid cementite, the average block grain size of pearlite is 15 μm to 35 μm, the area fraction of pearlite having a block grain size of 50 μm or more is 20% or less, and a region having a lamellar spacing of 150 nm or less in the pearlite is 20% or less in a region ranging from the surface to a depth of 1 mm.

PRIOR ART DOCUMENT

Patent Document

[Patent Document 1] Japanese Unexamined Patent Application, First Publication No. 2000-119805

[Patent Document 2] Japanese Unexamined Patent Application, First Publication No. 2001-181793

[Patent Document 3] Japanese Unexamined Patent Application, First Publication No. 2004-091912

[Patent Document 4] Japanese Unexamined Patent Application, First Publication No. 2011-219829

[Patent Document 5] PCT International Publication No. WO2014/208492

[Patent Document 6] Japanese Unexamined Patent Application, First Publication No. 2005-054260

[Patent Document 7] Japanese Unexamined Patent Application, First Publication No. 2005-036356

DISCLOSURE OF THE INVENTION

Problems to be Solved by the Invention

However, in a case where a steel cord is produced by using filaments produced using the wire rod disclosed in Patent Documents 1 to 5 or filaments disclosed in Patent Documents 6 and 7, there is a problem that a delamination phenomenon occurs in the filaments.

A delamination phenomenon is a phenomenon in which longitudinal cracks that cause cracking in a longitudinal direction are generated when a steel wire or a filament is twisted and deformed, and easily occurs when the strength of the steel wire or the filament increases.

Particularly, when the strength thereof increases, a twisting defect caused by the delamination phenomenon occurs, and the twisting cannot be properly performed.

As described above, in the related art, a wire rod for a steel cord in which cracking or the like caused by the delamination phenomenon can be prevented while high strength and workability are maintained after the finish drawing process cannot be obtained.

An object of the present invention is to provide a wire rod for a steel cord in which cracking or the like caused by a delamination phenomenon can be prevented while high strength and workability are maintained after a finish drawing process.

Means for Solving the Problem

The inventors conducted intensive research and development, and as a result, discovered the following. That is, when a wire rod for a steel cord has the following chemical composition, and has a surface part and a central part, and the surface part has a lower C content than that of the central part, and when thinning the lamellar cementite, lamellar cementite of the surface part of the filament for a steel cord is thinned, and cracks in cementite that become an origin of wire breaking become finer, and the ductility of the surface part can be significantly improved while ensuring the strength of the central part.

The present invention has been made on the basis of the above-described knowledge, and the gist is as follows.

(1) According to a first aspect of the present invention, there is provided a wire rod for a high strength steel cord, which has a wire diameter R of 3.5 mm to 8.0 mm and includes, in a chemical composition, by mass %: C: 0.70% to 1.20%; Si: 0.15% to 0.60%; Mn: 0.10% to 1.00%; N: 0.0010% to 0.0050%; Al: more than 0% and 0.0100% or less; and a remainder of Fe and impurities, in which a surface part and a central part are included, the surface part covers the central part, a thickness of the surface part is 50 μm to 0.20×R, the central part includes a pearlite structure in a proportion of 95% to 100% by area %, a C content of the surface part is 40% to 95% of a C content of the central part, and a ratio of a thickness of lamellar cementite at the center of the thickness of the surface part to a thickness of lamellar cementite in the central part is 95% or less.

(2) In the aspect of (1), the wire rod may further include, in the chemical composition, by mass %, one or two or more of Ti: more than 0% and 0.1000% or less, Cr: more than 0% and 0.5000% or less, Co: more than 0% and 0.5000% or less, V: more than 0% and 0.5000% or less, Cu: more than 0% and 0.2000% or less, Nb: more than 0% and 0.1000% or less, Mo: more than 0% and 0.2000% or less, W: more than 0% and 0.200% or less, B: more than 0% and 0.0030% or less, REM: more than 0% and 0.0050% or less, Ca: more than 0.0005% and 0.0050% or less, Mg: more than 0.0005% and 0.0050% or less, and Zr: more than 0.0005% and 0.0100% or less.

Effects of the Invention

In the wire rod for a high strength steel cord according to the aspect of the present invention, the ductility of the surface part is improved, the strength of the central part is ensured and the tensile strength of the wire rod for a high strength steel cord is 1100 MPa or more, therefore, after the wire rod for a high strength steel cord is subjected to wire drawing so that the wire diameter is 0.15 mm to 0.35 mm, a significant effect of suppressing the occurrence of a delamination phenomenon, preventing the occurrence of a twisting defect, and achieving a tensile strength of 3200 MPa or more can be exhibited.

EMBODIMENTS OF THE INVENTION

In an embodiment of the present invention, there is provided a wire rod for a high strength steel cord described in the following (A) or (B).

(A) A first aspect of the present invention is a wire rod for a high strength steel cord, which has a wire diameter R of 3.5 mm to 8.0 mm and includes, in a chemical composition, by mass %: C: 0.70% to 1.20%; Si: 0.15% to 0.60%; Mn: 0.10% to 1.00%; N: 0.0010% to 0.0050%; Al: more than 0% and 0.0100% or less; and a remainder of Fe and impurities, in which a surface part and a central part are included, the surface part covers the central part, a thickness of the surface part is 50 μm to 0.20×R, the central part includes a pearlite structure in a proportion of 95% to 100% by area %, a C content of the surface part is 40% to 95% of a C content of the central part, and a ratio of a thickness of lamellar cementite at the center of the thickness of the surface part to a thickness of lamellar cementite in the central part is 95% or less.

(B) In the aspect of (A) described above, the wire rod may further include, in the chemical composition, by mass %, one or two or more of Ti: more than 0% and 0.1000% or less, Cr: more than 0% and 0.5000% or less, Co: more than 0% and 0.5000% or less, V: more than 0% and 0.5000% or less, Cu: more than 0% and 0.2000% or less, Nb: more than 0% and 0.1000% or less, Mo: more than 0% and 0.2000% or less, W: more than 0% and 0.200% or less, B: more than 0% and 0.0030% or less, REM: more than 0% and 0.0050% or less, Ca: more than 0.0005% and 0.0050% or less, Mg: more than 0.0005% and 0.0050% or less, and Zr: more than 0.0005% and 0.0100% or less.

<Properties of Metallographic Structure>

The properties of the metallographic structure of the wire rod for a high strength steel cord in the embodiment will be described with reference to FIG. 1.

In a wire rod 20 for a high strength steel cord in the embodiment of the present invention, a wire diameter R as its diameter (hereinafter, referred to as a "wire diameter") R satisfies $$3.5\ \text{mm} \le R \le 8.0\ \text{mm} \quad \text{(Expression 1)}$$

and a surface part 21 and a central part 22 are included. Preferably, $$4.5\ \text{mm} \le R \le 7.0\ \text{mm} \quad \text{(Expression 2)}$$

is satisfied.

(Surface Part)

Since the surface part of the steel wire or the filament is mainly deformed during finish drawing performed in the process that the filament is produced by using the wire rod or during twisting performed when a steel cord is produced from the filament, the inventors have focused on that it is necessary for the surface part of the wire rod for a steel cord, which is a material of the steel wire or the filament, to have a good workability.

Figure 1:
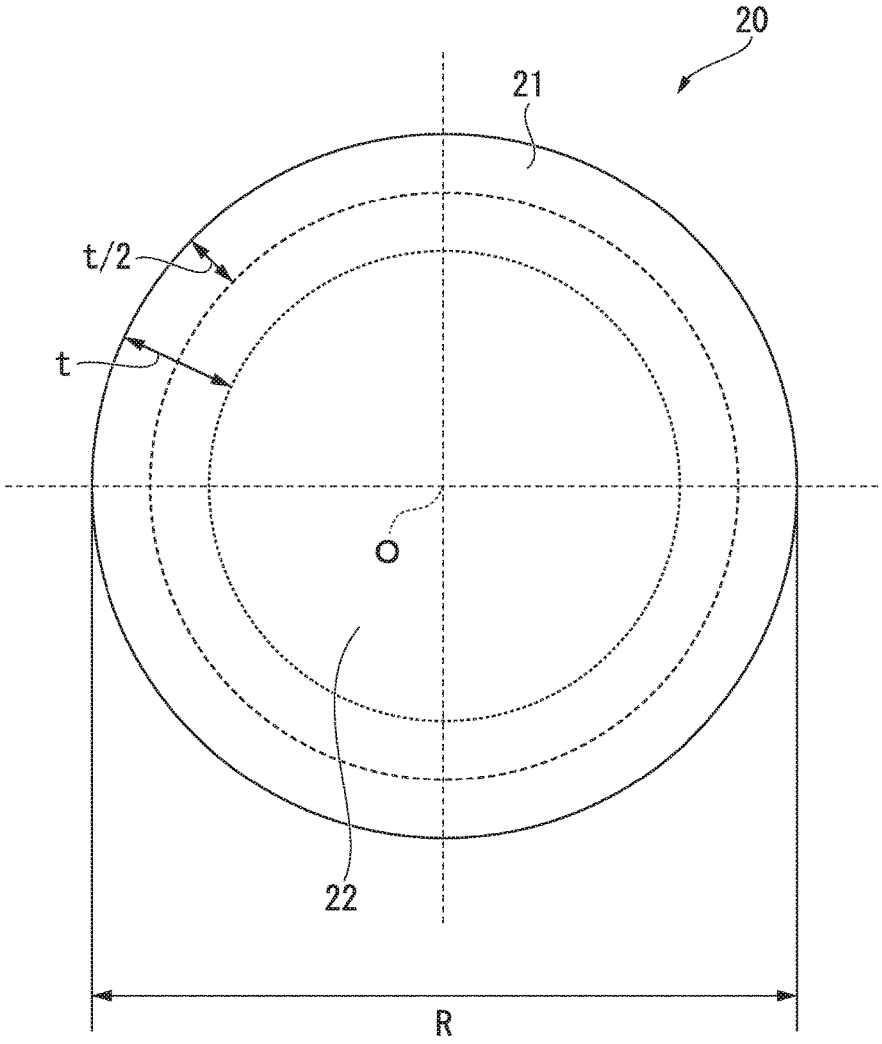
FIG. 1 is a view illustrating a cross section of a wire rod for a high strength steel cord in an embodiment of the present invention.

As illustrated in FIG. 1, the surface part 21 is a part having a thickness t from the outer circumferential surface of the wire rod 20 for a high strength steel cord. In addition, the thickness (hereinafter, referred to as the "thickness of the surface part") t of the surface part 21 is a region in a range of $$50\ \mu\text{m} \le t \le 0.20 \times R \quad \text{(Expression 3)}$$

with respect to the wire diameter R of the wire rod 20 for a high strength steel cord. Preferably, $$80\ \mu\text{m} \le t \le 0.15 \times R \quad \text{(Expression 4)}$$

is satisfied.

The surface part 21 has a lower C content than that of the central part 22 and has a C content of 40% to 95% of the C content of the center O of the wire rod 20 for a high strength steel cord.

The reason that the thickness t of the surface part is set to 50 μm to 0.2×R of the wire diameter R will be described.

First, when the thickness t of the surface part is set to 50 μm or more, workability can be sufficiently ensured, and the generation of defects such as cracks during finish drawing and twisting can be suppressed.

Second, when the thickness t of the surface part is set to 0.2×R or less, the strength of the steel cord can be sufficiently ensured.

Next, a position at a depth of t/2 from the outer circumferential surface, which is indicated by a dotted line in FIG. 1 is defined as the center of the thickness of the surface part (hereinafter, referred to as the "center of the surface part").

The thickness of lamellar cementite at the center of the surface part is 95% or less of the thickness of lamellar cementite in the central part, which will be described later.

The lamellar cementite means cementite having layered structure in the pearlite structure.

(Central Part)

The central part 22 includes the center O of the wire rod 20 for a high strength steel cord and is a part excluding the surface part.

The central part 22 has a substantially constant C content and is a region having a metallographic structure including a pearlite structure in a proportion of 95% to 100% by area %.

Accordingly, the strength of the central part 22 is sufficiently ensured, and it becomes possible to achieve a reduction in the weight of the steel cord.

(Measurement of Thickness of Lamellar Cementite)

Regarding the thickness of lamellar cementite, the transverse section of the wire rod is etched with picral to reveal the pearlite structure, eight points at every central angle of 45° in the cross section of a wire rod at the same depth from the surface layer were photographed with a FE-SEM at a magnification of 10,000-fold, the thickness of lamellar cementite was obtained in each visual field from lamellar cementite perpendicularly intersecting a line segment of 2 μm in the minimum lamellar spacing part of the observation photograph, and the average value of the eight points was determined.

In addition, the ratio (%) of the thickness of lamellar cementite in the surface part obtained as described above to the thickness of lamellar cementite in the central part of the filament was obtained.

Hereinafter, measurement points will be described with reference to FIG. 5.

Figure 5:
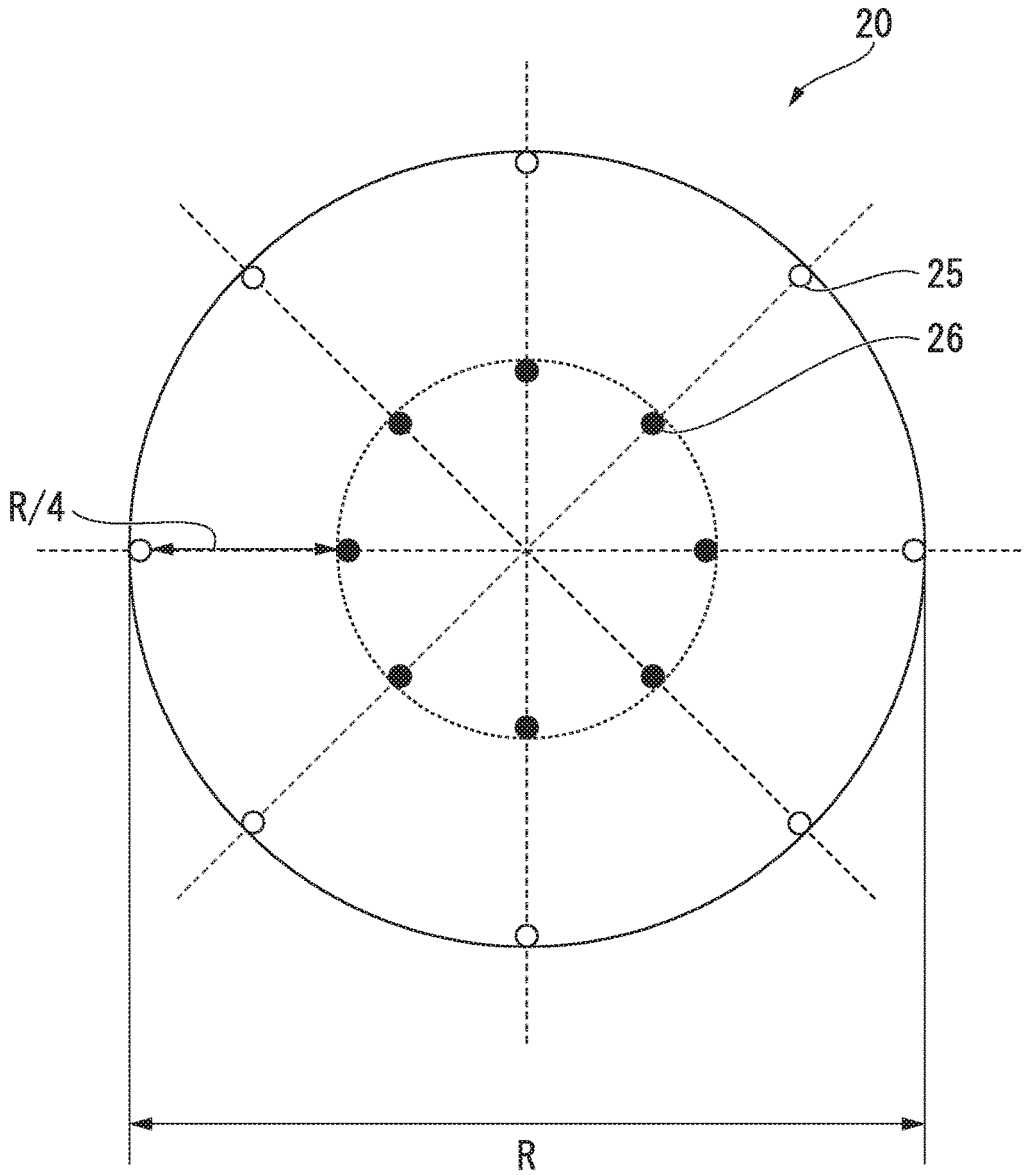
FIG. 5 is a view showing a method of measuring the thickness of lamellar cementite of the wire rod for a high strength steel cord in the embodiment of the present invention using a cross-sectional view of the wire rod for a high strength steel cord in the embodiment of the present invention.

FIG. 5 is a view illustrating a method of measuring the thickness of lamellar cementite of the wire rod for a high strength steel cord in the embodiment of the present invention using a cross-sectional view of the wire rod for a high strength steel cord in the embodiment of the present invention.

In the cross-sectional view of the wire rod 20 for a high strength steel cord in the embodiment of the present invention, eight dotted lines are drawn in a radial direction from the center at every central angle of 45°, eight black circles 26 are measurement points of the central part, and eight white circles 25 are measurement points of the surface part.

When it is assumed that the average value of the thicknesses of lamellar cementite of the surface part is ds and the average value of the thicknesses of lamellar cementite in the central part is di, the ratio p of the thickness of lamellar cementite at the center of the thickness of the surface part to the thickness of lamellar cementite in the central part is obtained as below.

$$p = (ds/di) \times 100(\%) \quad \text{(Expression 5)}$$

The feature of the wire rod for a high strength steel cord in the embodiment of the present invention is that p is 95% or less and the lower limit of p is 50% or preferably 60%.

(Operational Effects)

In the wire rod for a high strength steel cord in the embodiment of the present invention, the ductility of the surface part is improved and the strength of the central part is ensured, therefore, the wire rod for a high strength steel cord in the embodiment of the present invention has a significant effect of achieving excellent workability during finish drawing performed in the process that a filament is produced by using the wire rod or during twisting performed when a steel cord is produced from the filament.

<Chemical Composition>

The wire rod includes, in the chemical composition, by mass %, C: 0.70% to 1.20%, Si: 0.15% to 0.60%, Mn: 0.10% to 1.00%, N: 0.0010% to 0.0050%, Al: more than 0% and 0.0100% or less, and a remainder of Fe and impurities.

The wire rod may further include, in the chemical composition, by mass %, one or two or more of Ti: more than 0% and 0.1000% or less, Cr: more than 0% and 0.5000% or less, Co: more than 0% and 0.5000% or less, V: more than 0% and 0.5000% or less, Cu: more than 0% and 0.2000% or less, Nb: more than 0% and 0.1000% or less, Mo: more than 0% and 0.2000% or less, W: more than 0% and 0.200% or less, B: more than 0% and 0.0030% or less, REM: more than 0% and 0.0050% or less, Ca: more than 0.0005% and 0.0050% or less, Mg: more than 0.0005% and 0.0050% or less, and Zr: more than 0.0005% and 0.0100% or less.

It will be described in detail chemical composition as below. Hereinafter, it will be described in terms of mass %.

(C: 0.70% to 1.20%)

C is an element that improves the strength of steel. In order to obtain a pearlite structure which is a eutectoid structure, the C content is preferably set to about 0.8%. Here, when the C content is less than 0.70%, a hypoeutectoid structure is formed, and a non-pearlite structure is present in a large proportion. On the other hand, when the C content is more than 1.20%, proeutectoid cementite is precipitated, and there is concern that the workabilities of the wire rod, the steel wire manufactured from the wire rod and the filament may be deteriorated. Therefore, the C content is set to be in a range of 0.70% to 1.20%.

(Si: 0.15% to 0.60%)

Si is an element that is effective in deoxidizing the steel, and is an element having a function of improving strength by being solid-solutionized in ferrite. Here, when the Si content is less than 0.15%, there is concern that the above-described operational effect cannot be sufficiently exhibited. On the other hand, when the Si content is more than 0.60%, there is concern that workability may be deteriorated. Therefore, the Si content is set to be in a range of 0.15% to 0.60%.

(Mn: 0.10% to 1.00%)

Mn is an element that is effective in deoxidizing the steel and has an operational effect of fixing S in the steel and thus suppressing the embrittlement of the steel. Here, when the Mn content is less than 0.10%, there is concern that the above-described effect cannot be sufficiently exhibited. On the other hand, when the Mn content is more than 1.00% there is concern that workability may be deteriorated.

Therefore, the Mn content is set to be in a range of 0.10% to 1.00%.

(N: 0.0010% to 0.0050%)

N is an element that forms nitrides of Al and Ti and has an operational effect of suppressing coarsening of an austenite grain size. Here, when the N content is less than 0.0010%, there is concern that the above-described operational effect cannot be sufficiently exhibited. On the other hand, when the N content is more than 0.0050%, there is concern that ductility may be deteriorated.

Therefore, the N content is set to be in a range of 0.0010% to 0.0050%.

(Al: More than 0% and 0.0100% or Less)

Al is an element having a deoxidizing action. The Al content is set to be more than 0% and 0.010% or less so as not to allow the generation of hard and non-deformable alumina-based inclusions, which may cause the deterioration in the ductility of the wire rod and the deterioration in drawability.

In addition, the limit of detection of Al is less than 0.001%.

In addition, the amounts of P and S which are impurities are not particularly specified and are preferably set to 0.0200% or less from the viewpoint of ensuring ductility to the same degree as that of a filament in the related art.

In addition to the base elements and impurity elements mentioned above, a wire rod 20 for a high strength steel cord according to the embodiment may further contain, as selective elements, at least one of Ti, Cr, Co, V, Cu, Nb, Mo, W, B, REM, Ca, Mg, and Zr. Hereinafter, the range limits of the numerical values of the selective elements and the reason for the limitation will be described. Here, % described herein indicates mass %.

(Ti: More than 0% and 0.1000% or Less)

Ti is an element having a deoxidizing action. In addition, Ti has an operational effect of forming nitrides and suppressing coarsening of the austenite grain size.

Here, when the Ti content is more than 0.1000%, there is concern that workability may be deteriorated due to coarse carbonitrides (TiCN and the like).

When the Ti content is less than 0.005%, there is concern that the above-described operational effect cannot be sufficiently exhibited, therefore, the Ti content is typically set to 0.005% or more. However, in a case where Al is contained, the Ti content may be set to be less than 0.0050%.

Therefore, the Ti content is set to be in a range of more than 0% and 0.1000% or less. The Ti content is more preferably in a range of 0.0050% to 0.1000%.

(Cr: More than 0% and 0.5000% or Less)

Cr makes the lamellar spacing of pearlite finer and improves the strength of the wire rod. In order to obtain this effect, the Cr content is preferably more than 0% and 0.5000% or less.

The Cr content is more preferably 0.0010% to 0.5000%. When the Cr content is more than 0.5000%, pearlitic transformation is excessively suppressed, and there is concern that austenite may remain in the metallographic structure of the wire rod during a patenting treatment and supercooled structures such as martensite and bainite may be generated in the metallographic structure of the wire rod after the patenting treatment. In addition, there may be cases where it becomes difficult to remove surface oxides by mechanical descaling.

(Co: More than 0% and 0.5000% or Less)

Co is an element that suppresses precipitation of proeutectoid cementite. In order to obtain this effect, the Co content is preferably more than 0% and 0.5000% or less. The Co content is more preferably 0.0010% to 0.5000%. When the Co content is more than 0.5000%, this effect is saturated, and there may be cases where the cost for the inclusion of Co outweighs the benefits.

(V: More than 0% and 0.5000% or Less)

V is an element that forms fine carbonitrides, suppresses coarsening of austenite grains in a high temperature range, and improves the strength of the wire rod. In order to obtain these effects, the V content is preferably more than 0% and 0.5000% or less.

The V content is more preferably 0.0010% to 0.5000%. When the V content is more than 0.5000%, the amount of formed carbonitrides increases, and the particle size of the carbonitrides increases, therefore, there may be cases where the ductility of the wire rod is deteriorated.

(Cu: More than 0% and 0.2000% or Less)

Cu is an element that improves corrosion resistance. In order to obtain this effect, the Cu content is preferably more than 0% and 0.2000% or less.

The Cu content is more preferably 0.0001% to 0.2000% When the Cu content is more than 0.2000%, Cu reacts with S and is segregated in the grain boundaries as CuS, and there may be cases where flaws occur in the wire rod.

(Nb: More than 0% and 0.1000% or Less)

Nb has an effect of improving corrosion resistance. In addition, Nb is an element that forms carbides or nitrides, and suppresses coarsening of austenite grains in a high temperature range. In order to obtain these effects, the Nb content is preferably more than 0% and 0.1000% or less.

The Nb content is more preferably 0.0005% to 0.1000%.

When the Nb content is more than 0.1000%, there may be cases where pearlitic transformation is suppressed during the patenting treatment.

(Mo: More than 0% and 0.2000% or Less)

Mo is an element that is concentrated at the pearlite growth interface and suppresses the growth of pearlite due to a so-called solute drag effect. In addition, Mo is an element that suppresses the generation of ferrite and reduces the non-pearlite structure. In order to obtain these effects, the Mo content is preferably more than 0% and 0.2000% or less.

The Mo content is more preferably 0.0010% to 0.2000%.

The Mo content is even more preferably 0.005% to 0.0600%.

When the Mo content is more than 0.2000%, the growth of pearlite is suppressed, and it takes a long time to perform the patenting treatment, therefore, there may be cases where productivity may be deteriorated.

In addition, when the Mo content is more than 0.2000%, coarse $Mo_2C$ carbides are precipitated, and there may be cases where drawability is deteriorated.

(W: More than 0% and 0.2000% or Less)

Like Mo, W is an element that is concentrated at the pearlite growth interface and suppresses the growth of pearlite due to the so-called solute drag effect. In addition, W is an element that suppresses the generation of ferrite and reduces the non-pearlite structure. In order to obtain these effects, the W content is preferably more than 0% and 0.2000% or less.

The W content is more preferably 0.0005% to 0.2000%.

The W content is even more preferably 0.0050% to 0.0600%.

When the W content is more than 0.20%, the growth of pearlite is suppressed, and it takes a long time to perform the patenting treatment, therefore, there may be cases where productivity may be deteriorated. In addition, when the W content is more than 0.2000%, coarse $W_2C$ carbides are precipitated, and there may be cases where drawability is deteriorated.

(B: More than 0% and 0.0030% or Less)

B is an element that suppresses the generation of non-pearlite such as ferrite, degenerate-pearlite, and bainite. In addition, B is an element that forms carbides or nitrides, and suppresses coarsening of austenite grains in a high temperature range. In order to obtain these effects, the B content is preferably more than 0% and 0.0030% or less.

The B content is more preferably 0.0004% to 0.0025%.

The B content is even more preferably 0.0004% to 0.0015%.

The B content is most preferably 0.0006% to 0.0012%.

When the B content is more than 0.0030%, the precipitation of coarse $Fe_{23}(CB)_6$ carbides is promoted, and there may be cases where ductility is adversely affected.

(REM: More than 0% and 0.0050% or Less)

Rare earth metal (REM) is a deoxidizing element. In addition, REM is an element that forms sulfides and detoxifies S which is an impurity. In order to obtain this effect, the REM content is preferably more than 0% and 0.0050% or less.

The REM content is more preferably 0.0005% to 0.0050%.

When the REM content is more than 0.0050%, coarse oxides are formed, and there may be cases where wire breaking occurs during drawing. In addition, REM is a generic term for a total of 17 elements including 15 elements from lanthanum with atomic number 57 to lutetium with atomic number 71, scandium with atomic number 21, and yttrium with atomic number 39. Typically, REM is supplied in the form of mischmetal which is a mixture of these elements and is added to the steel.

(Ca: More than 0.0005% and 0.0050% or Less)

Ca is an element that reduces hard alumina-based inclusions. In addition, Ca is an element that forms fine oxides. As a result, the pearlite block size of the wire rod becomes finer, and the ductility of the wire rod is improved. In order to obtain these effects, the Ca content is preferably more than 0.0005% and 0.0050% or less.

The Ca content is more preferably 0.0005% to 0.0040%.

When the Ca content is more than 0.0050%, coarse oxides are formed, and there may be cases where wire breaking occurs during drawing. In addition, in typical operational conditions, Ca is unavoidably contained at an amount of about 0.0003%.

(Mg: More than 0.0005% and 0.0050% or Less)

Mg is an element that forms fine oxides in the steel. As a result, the pearlite block size of the wire rod becomes finer, and the ductility of the wire rod is improved. In order to obtain this effect, the Mg content is preferably more than 0.0005% and 0.0050% or less.

The Mg content is more preferably more than 0.0005% and 0.0040% or less.

When the Mg content is more than 0.0050%, coarse oxides are formed, and there may be cases where wire breaking occurs during drawing.

In addition, in typical operational conditions, Mg is unavoidably contained at an amount of about 0.0001%.

(Zr: More than 0.0005% and 0.0100% or Less)

Zr is crystallized as ZrO and becomes the crystallization nucleus of austenite and is thus an element that increases the equiaxed austenite ratio and makes austenite grains finer.

As a result, the pearlite block size of the wire rod becomes finer, and the ductility of the wire rod is improved. In order to obtain this effect, the Zr content is preferably more than 0.0005% and 0.0100% or less.

The Zr content is more preferably 0.0005% to 0.0050%.

When the Zr content is more than 0.010%, coarse oxides are formed, and there may be cases where wire breaking occurs during drawing.

(Operational Effects)

Since the chemical composition and the metallographic structure are employed, the central part of the wire rod for a high strength steel cord in the embodiment includes the pearlite structure in a proportion of 95% to 100% by area %, and thus the central part ensures sufficient strength and has excellent ductility.

As a result, for example, after wire drawing is performed so that the wire diameter is 0.15 mm to 0.35 mm, the occurrence of a delamination phenomenon is suppressed, the occurrence of a twisting defect can be prevented, and a reduction in the weight of the steel cord can be achieved.

<Production Method>

Figure 2:
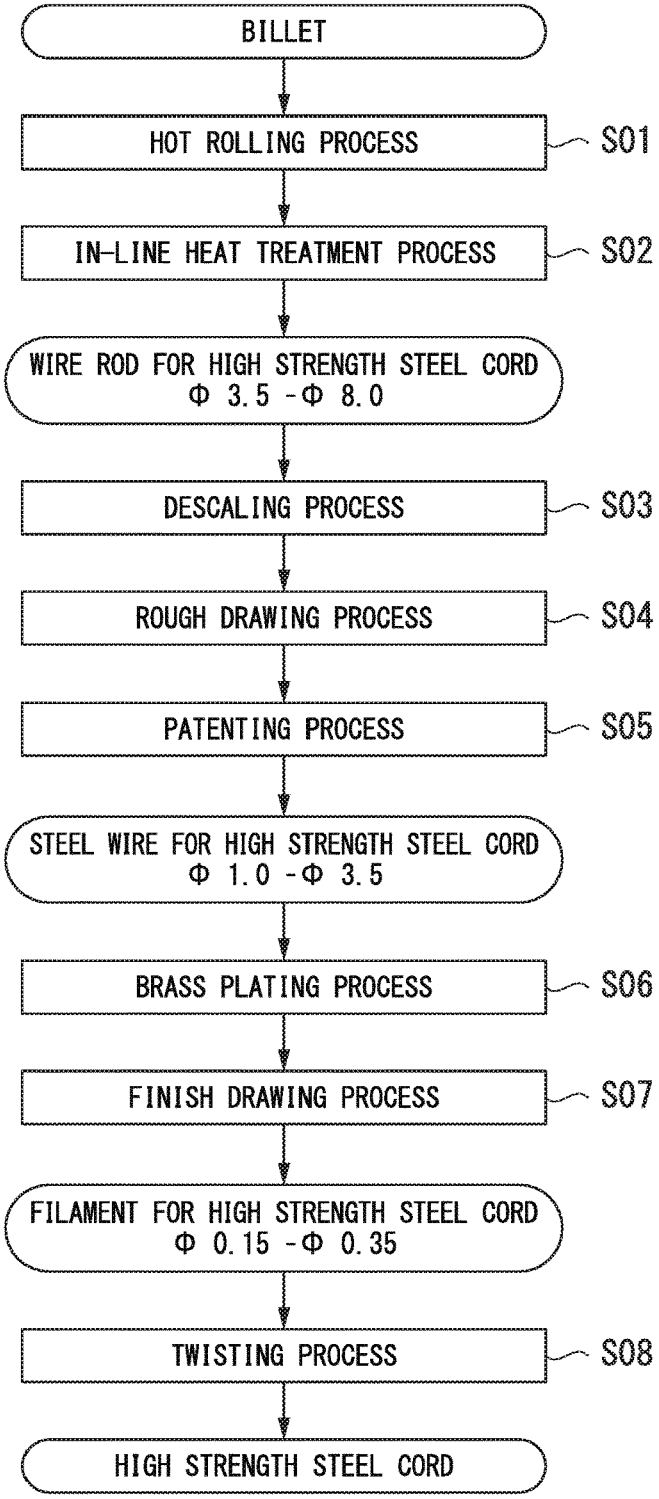
FIG. 2 is a flowchart illustrating a production method of the wire rod for a high strength steel cord in the embodiment of the present invention.

A production method of the wire rod for a high strength steel cord in the embodiment of the present invention and a method for producing the filament for a high strength steel cord using the wire rod will be described with reference mainly to FIG. 2.

(Chemical Composition)

In order to produce the wire rod for a high strength steel cord in the embodiment of the present invention, a billet adjusted to the following chemical composition is used.

For example, the billet contains, in the chemical composition, by mass %, C: 0.70% to 1.20%, Si: 0.15% to 0.60%, Mn: 0.10% to 1.00%, N: 0.0010% to 0.0050%, Al: more than 0% and 0.0100% or less, and a remainder of Fe and impurities.

The billet may further contain, in the chemical composition, by mass %, one or two or more of Ti: more than 0% and 0.1000% or less, Cr: more than 0% and 0.5000% or less, Co:

more than 0% and 0.5000% or less, V: more than 0% and 0.5000% or less, Cu: more than 0% and 0.2000% or less, Nb: more than 0% and 0.1000% or less, Mo: more than 0% and 0.2000% or less, W: more than 0% and 0.200% or less, B: more than 0% and 0.0030% or less, REM: more than 0% and 0.0050% or less, Ca: more than 0.0005% and 0.0050% or less, Mg: more than 0.0005% and 0.0050% or less, and Zr: more than 0.0005% and 0.0100% or less.

(Hot Rolling Process S01)

The billet is heated to 950° C. to 1250° C. in a heating furnace and is subjected to hot finish rolling to a wire diameter of 3.5 mm to 8.0 mm in this process. The finish rolling temperature is 950° C. to 1050° C., and a time needed for the finish rolling to a wire diameter of φ 8 mm or less is 0.1 seconds to 10 seconds.

During heating in the heating furnace, the amount of decarburization from the surface layer is controlled by the heating furnace atmosphere, heating temperature, and heating time so that the C content in the vicinity of the surface layer of the wire rod after being rolled is 40% to 95% of the C content at the center O.

Figure 3:
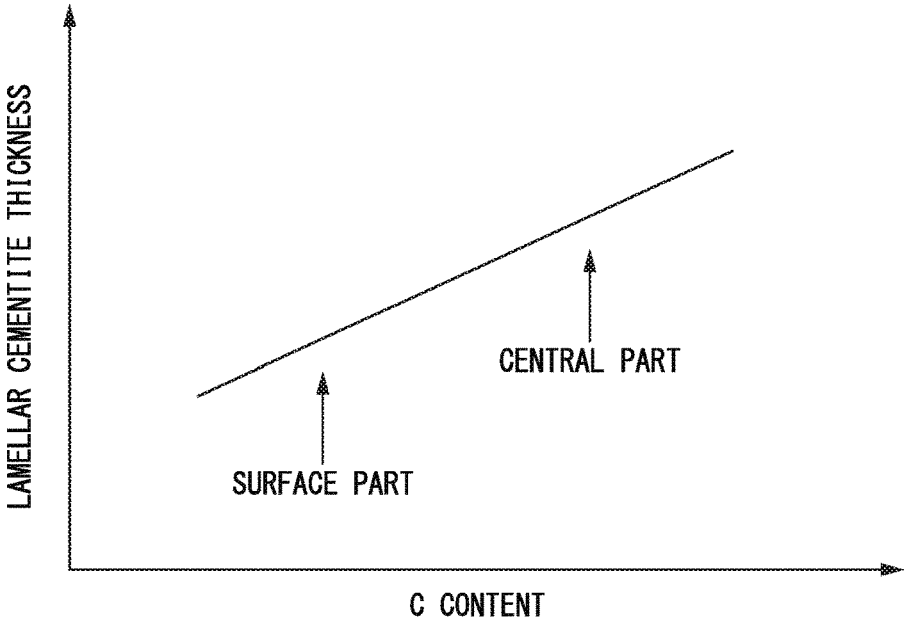
FIG. 3 is a conceptual diagram showing the relationship between the C content of drawn pearlite steel and the thickness of lamellar cementite.

FIG. 3 is a conceptual diagram showing the relationship between the C content of drawn pearlite steel and the thickness of lamellar cementite. In FIG. 3, the horizontal axis represents the C content, and the vertical axis represents the thickness of lamellar cementite. The C content increases toward the right in the horizontal axis, and the thickness of lamellar cementite increases upward in the vertical axis.

In the the filament for a high strength steel cord in the embodiment of the present invention, as illustrated in FIG. 3, the C content becomes different between the vicinity of the center of the wire rod and the surface part 21 after the hot rolling by controlling the decarburization content such that the central part 22 and the surface part 21 are formed.

(In-Line Heat Treatment Process S02)

The finish rolled wire rod is wound at 900° C.±100° C., is air-cooled to 500° C. to 600° C. at 10° C./s to 20° C./s, and is held or subjected to DLP at 500° C. to 600° C. While being held or subjected to DLP at 500° C. to 600° C., the temperature of the center of the wire rod is 530° C. to 630° C.

The inventors found that in this in-line heat treatment process, the ratio of the thickness of lamellar cementite at the center of the thickness of the surface part of the wire rod to the thickness of lamellar cementite in the central part of the wire rod reaches 95% or less.

As described above, in the hot rolling process S01 and the in-line heat treatment process S02, the wire rod for a high strength steel cord in the embodiment of the present invention is produced.

Although subsequent processes are the process that produces the filament for a high strength steel cord by using the wire rod for a high strength steel cord in the embodiment of the present invention, it will be described so as to understand the influence that the feature of the central part 22 and the surface part 21 of the wire rod for a high strength steel cord in the embodiment of the present invention affects the filament for a high strength steel cord.

(Descaling Process S03)

Next, the wire rod for a high strength steel cord in the embodiment of the present invention, which is produced through the hot rolling, is subjected to a chemical treatment such as pickling or a mechanical treatment to remove oxide scale formed on the surface thereof.

(Rough Drawing Process S04)

Next, the wire rod for a high strength steel cord in the embodiment of the present invention from which oxide scale has been removed is subjected to dry drawing, and therefore, a steel wire having a wire diameter of 1.0 mm to 3.5 mm is formed.

(Patenting Process S05)

Next, after the steel wire formed through the rough drawing process S04 is heated to 850° C. to 1000° C., and a patenting treatment is immediately performed under a temperature condition of 530° C. to 580° C. so that the steel wire is high-strengthened.

Even after the patenting process, a state in which the C content of the surface part of the wire rod for a high strength steel cord in the embodiment of the present invention is low continues, and the C content of the surface part of the steel wire for a high strength steel cord is low and lamellar cementite of the surface part is fine even in the steel wire for a high strength steel cord.

(Brass Plating Process S06)

Brass plating is performed on the surface of the steel wire for a high strength steel cord. A brass plating is formed to ensure the adhesion between rubber and a steel cord.

(Finish Drawing Process S07)

Then, wet drawing is performed on the steel wire for a high strength steel cord subjected to the brass plating to achieve a wire diameter of 0.15 mm to 0.35 mm. Accordingly, the filament for a high strength steel cord is produced.

Figure 4:
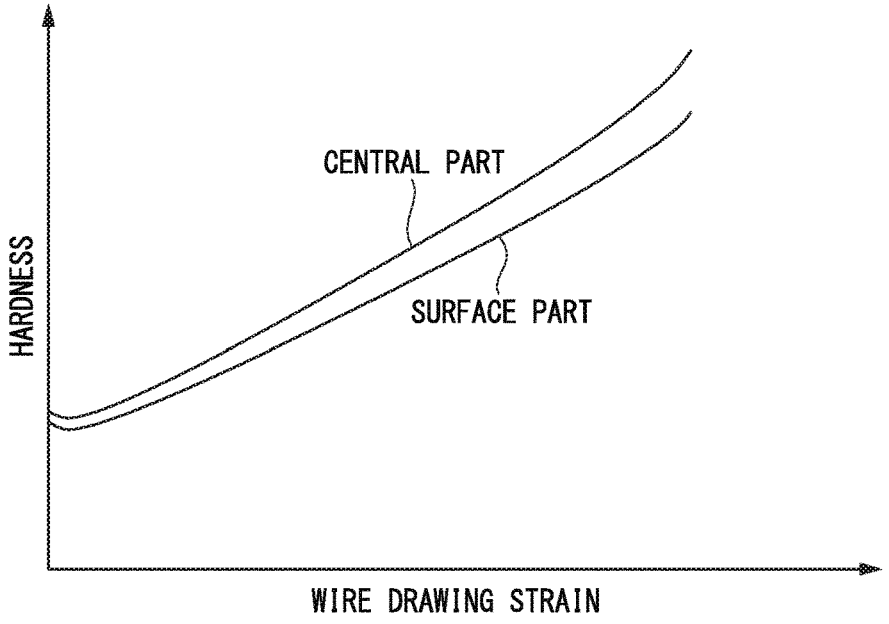
FIG. 4 is a conceptual diagram showing the relationship between the wire drawing strain and the hardness.

FIG. 4 is a conceptual diagram showing the relationship between the wire drawing strain and the hardness. In FIG. 4, the horizontal axis represents the wire drawing strain, and the vertical axis represents the hardness. The wire drawing strain increases toward the right in the horizontal axis, and the hardness increases upward in the vertical axis.

As shown in FIG. 4, in a case where the steel wire produced by using the wire rod for a high strength steel cord in the embodiment of the present invention having a central part 22 and a surface part 21 is subjected to the finish drawing, the difference in the hardness between the central part and the surface part is increased.

(Twisting Process S08)

Next, twisting is performed using a plurality of filaments for a high strength steel cord. Accordingly, a high strength steel cord having a twisted structure is produced.

(Operational Effects)

In the wire rod for a high strength steel cord in the embodiment of the present invention, the ductility of the surface part is improved and the strength of the central part is ensured, therefore, the wire rod for a high strength steel cord in the embodiment of the present invention has high strength and a significant effect of achieving excellent workability during twisting performed when a steel cord is produced.

While the wire rod for a high strength steel cord in the embodiment of the present invention has been described above, the wire diameter of the hot rolled wire rod or the wire diameter of the filament for a high strength steel cord are not limited to the following Examples as long as the wire diameters and the like are within the ranges of the embodiment.

Example 1

In a case where C: 0.70% to 1.20%, Si: 0.15% to 0.60%, Mn: 0.10% to 1.00%, N: 0.0010% to 0.0050%, Al: more than 0% and 0.0100% or less, and a remainder of Fe and impurities are included in the chemical composition by mass %, the effects of the present invention will be described using Examples of the present invention and Comparative Examples.

In Table 1, the chemical compositions of Examples of the present invention and Comparative Examples are shown.

Regarding the Al composition in Table 1, the description "---" indicates that the Al content is less than the limit of detection of Al.

[Table 1]

TABLE1

| Type | No. | CHEMICALCOMPOSITION (mass*) | | | | |
|---|---|---|---|---|---|---|
| | | C | Si | Mn | Al | N |
| EXAMPLES OF PRESENT INVENTION | 1 | 0.72 | 0.16 | 0.11 | 0.006 | 0.0025 |
| | 2 | 0.71 | 0.17 | 0.79 | | 0.0011 |
| | 3 | 0.71 | 0.16 | 0.99 | | 0.0028 |
| | 4 | 0.73 | 0.31 | 0.12 | | 0.0026 |
| | 5 | 0.71 | 0.30 | 0.79 | | 0.0035 |
| | 6 | 0.72 | 0.32 | 0.99 | 0.006 | 0.0048 |
| | 7 | 0.71 | 0.59 | 0.11 | | 0.0034 |
| | 8 | 0.71 | 0.58 | 0.79 | 0.009 | 0.0031 |
| | 9 | 0.71 | 0.59 | 0.98 | 0.001 | 0.0031 |
| | 10 | 0.82 | 0.17 | 0.99 | | 0.0028 |
| | 11 | 0.81 | 0.31 | 0.12 | | 0.0026 |
| | 12 | 0.80 | 0.58 | 0.79 | | 0.0035 |
| | 13 | 0.88 | 0.59 | 0.12 | 0.001 | 0.0034 |
| | 14 | 0.89 | 0.34 | 0.98 | 0.003 | 0.0031 |
| | 15 | 0.90 | 0.17 | 0.78 | | 0.0031 |
| | 16 | 0.99 | 0.30 | 0.98 | | 0.0028 |
| | 17 | 0.98 | 0.59 | 0.12 | | 0.0026 |
| | 18 | 1.00 | 0.17 | 0.99 | 0.003 | 0.0035 |
| | 19 | 1.09 | 0.17 | 0.98 | 0.001 | 0.0034 |
| | 20 | 1.07 | 0.31 | 0.12 | | 0.0031 |
| | 21 | 1.09 | 0.59 | 0.79 | | 0.0031 |
| | 22 | 1.19 | 0.16 | 0.12 | 0.003 | 0.0031 |
| | 23 | 1.18 | 0.30 | 0.79 | | 0.0028 |
| | 24 | 1.19 | 0.59 | 0.98 | 0.002 | 0.0026 |
| COMPARATIVE EXAMPLES | 25 | 0.68 | 0.16 | 0.12 | 0.005 | 0.0031 |
| | 26 | 1.23 | 0.30 | 0.79 | | 0.0028 |
| | 27 | 0.80 | 0.12 | 0.12 | | 0.0026 |
| | 28 | 0.72 | 0.65 | 0.13 | | 0.0035 |
| | 29 | 0.81 | 0.17 | 0.09 | | 0.0035 |
| | 30 | 0.89 | 0.39 | 1.05 | 0.006 | 0.0048 |

TABLE1-continued

| Type | No. | CHEMICALCOMPOSITION (mass*) | | | | |
|---|---|---|---|---|---|---|
| | | C | Si | Mn | Al | N |
| | 31 | 0.82 | 0.29 | 0.12 | 0.012 | 0.0036 |
| | 32 | 0.79 | 0.25 | 0.35 | | 0.0055 |
| | 33 | 0.89 | 0.39 | 0.46 | 0.003 | 0.0031 |
| | 34 | 0.82 | 0.29 | 0.12 | 0.005 | 0.0031 |

Wire rods for a high strength steel cord of Examples 1 to 24 of the present invention and Comparative Examples 25 to 34 were produced by the methods described in the hot rolling process S01 and the in-line heat treatment process S02.

For the obtained wire rod for a high strength steel cord, the center pearlite area fraction (%), the wire diameter R (mm), the thickness (μm) of the surface part, the ratio (%) between the lamellar cementite thicknesses of the surface part and the central part, the tensile strength (MPa), the presence or absence of delamination after finish drawing, and the tensile strength (MPa) were evaluated.

During the finish drawing, wet drawing was performed on the steel wire for a high strength steel cord subjected to the brass plating to achieve a wire diameter of 0.15 mm to 0.35 mm.

In addition, the presence or absence of delamination was determined by conducting a torsion test on the filament. In a case where a torsion test is conducted on the filament, when delamination occurs, a fracture surface generated due to torsional fracture is not a shear fracture surface but a fractured surface generated along longitudinal cracks. Therefore, the presence or absence of delamination can be determined by visually determining the fractured shape of the steel wire formed due to torsional fracture.

In addition, the tensile strength TS was obtained by a tensile test based on "Method of tensile test for metallic materials" in JIS Z 2241.

[Table 2]

TABLE 2

| | | EVALUATION OF CHARACTERISTICS OF WIREROD | | | | | EVALUATION OF CHARACTERISTICS OF STEEL WIRE AFTER WIRE DRAWING | | | |
|---|---|---|---|---|---|---|---|---|---|---|
| TYPE | No. | CENTER PEARLITE AREA FRACTION (%) | WIRE DIAMETER (mm) | THICKNESS OF SURFACE PART (μm) | RATIO BETWEEN LAMELLAR CEMENTITE THICKNESSES (*) | TENSILE STRENGTH TS (MPa) | WIRE DIAMETER AFTERWIRE DRAWING (mm) | OCCURRENCE OF DELAMINATION | TENSILE STRENGTH TS (MPa) | COMPREHENSIVE EVALUATION |
| EXAMPLES OF PRESENT INVENTION | 1 | 96 | 5.5 | 985 | 72 | 1132 | 0.15 | ABSENT | 3702 | G |
| | 2 | 97 | 5.5 | 921 | 74 | 1214 | 0.18 | ABSENT | 3817 | G |
| | 3 | 98 | 3.5 | 345 | 83 | 1167 | 0.20 | ABSENT | 3736 | G |
| | 4 | 95 | 4.0 | 196 | 89 | 1172 | 0.30 | ABSENT | 3760 | G |
| | 5 | 97 | 5.5 | 166 | 91 | 1192 | 0.35 | ABSENT | 3803 | G |
| | 6 | 98 | 5.5 | 53 | 94 | 1288 | 0.15 | ABSENT | 3714 | G |
| | 7 | 97 | 5.5 | 473 | 84 | 1222 | 0.18 | ABSENT | 3759 | G |
| | 8 | 96 | 5.5 | 54 | 94 | 1134 | 0.20 | ABSENT | 3713 | G |
| | 9 | 97 | 5.5 | 970 | 73 | 1255 | 0.30 | ABSENT | 3727 | G |
| | 10 | 98 | 5.5 | 969 | 73 | 1222 | 0.35 | ABSENT | 4003 | G |
| | 11 | 95 | 5.5 | 475 | 84 | 1252 | 0.15 | ABSENT | 3993 | G |
| | 12 | 98 | 5.5 | 928 | 74 | 1426 | 0.18 | ABSENT | 3994 | G |
| | 13 | 97 | 3.5 | 975 | 71 | 1423 | 0.20 | ABSENT | 4197 | G |
| | 14 | 98 | 8.0 | 712 | 84 | 1462 | 0.30 | ABSENT | 4204 | G |
| | 15 | 97 | 5.5 | 486 | 84 | 1446 | 0.35 | ABSENT | 4217 | G |
| | 16 | 98 | 5.5 | 953 | 73 | 1468 | 0.15 | ABSENT | 4325 | G |
| | 17 | 99 | 7.0 | 645 | 83 | 1468 | 0.18 | ABSENT | 4303 | G |
| | 18 | 97 | 5.5 | 829 | 76 | 1492 | 0.20 | ABSENT | 4287 | G |
| | 19 | 96 | 4.0 | 372 | 83 | 1510 | 0.30 | ABSENT | 4514 | G |
| | 20 | 97 | 5.5 | 500 | 83 | 1560 | 0.35 | ABSENT | 4537 | G |
| | 21 | 96 | 5.5 | 875 | 75 | 1570 | 0.15 | ABSENT | 4549 | G |
| | 22 | 98 | 5.5 | 522 | 83 | 1603 | 0.18 | ABSENT | 4747 | G |
| | 23 | 97 | 5.0 | 648 | 79 | 1630 | 0.20 | ABSENT | 4780 | G |
| | 24 | 96 | 5.5 | 599 | 81 | 1100 | 0.30 | ABSENT | 4781 | G |
| COMPARATIVE EXAMPLES | 25 | 93 | 5.5 | 968 | 72 | 1080 | 0.30 | ABSENT | 3136 | B |
| | 26 | 97 | 5.5 | 483 | 84 | 1530 | 0.18 | PRESENT | 4772 | B |
| | 27 | 96 | 5.5 | 935 | 73 | 1092 | 0.20 | ABSENT | 3146 | B |
| | 28 | 95 | 5.5 | 1059 | 70 | 1280 | 0.20 | PRESENT | 3983 | B |
| | 29 | 95 | 5.5 | 487 | 83 | 1396 | 0.23 | PRESENT | 3994 | B |
| | 30 | 96 | 5.5 | 488 | 82 | 1273 | 0.25 | PRESENT | 4014 | B |
| | 31 | 95 | 5.5 | 959 | 72 | 1274 | 0.21 | PRESENT | 3995 | B |
| | 32 | 97 | 5.5 | 501 | 81 | 1163 | 0.18 | PRESENT | 3881 | B |
| | 33 | 96 | 5.5 | 33 | 96 | 1277 | 0.21 | PRESENT | 3967 | B |
| | 34 | 96 | 5.5 | 1125 | 68 | 1060 | 0.20 | ABSENT | 3105 | B |

The evaluation results are shown in Table 2.

In Examples 1 to 24 of the present invention, the tensile strength of the wire rod was 1100 MPa or more, the delamination phenomenon had not occurred after the wire drawing was performed so that the wire diameter was 0.15 mm to 0.35 mm, and the tensile strength thereof was 3200 MPa or more, and therefore, the comprehensive evaluation was graded as good (G).

The comprehensive evaluation of Comparative Examples 25 to 34 was graded as bad (B). Hereinafter, the reason that the comprehensive evaluation of Comparative Examples 25 to 34 was graded as bad (B) will be described.

In Comparative Example 25, since the C content was 0.68% that is less than the lower limit, the center pearlite area fraction of the wire rod was 93% that is less than the lower limit, and the tensile strength of the wire rod was 1080 MPa that is a value less than 1100 MPa. In addition, the tensile strength was 3136 MPa that is a value less than 3200 MPa, after wire drawing was performed such that a wire diameter was 0.30 mm.

In Comparative Example 26, since the C content was 1.23% that is more than the upper limit, the tensile strength of the wire rod was 1530 MPa. However, delamination had occurred, after wire drawing was performed such that a wire diameter was 0.18 mm.

In Comparative Example 27, since the Si content was 0.12% that is less than the lower limit and the tensile strength of the wire rod was 1092 MPa that is a value less than 1100 MPa. In addition, the tensile strength was 3146 MPa that is a value less than 3200 MPa, after wire drawing was performed such that a wire diameter was 0.20 mm.

In Comparative Example 28, since the Si content was 0.65% that is more than the upper limit, delamination had occurred, after wire drawing was performed such that a wire diameter was 0.20 mm.

In Comparative Example 29, since the Mn content was 0.09% that is less than the lower limit, delamination had occurred, after wire drawing was performed such that a wire diameter was 0.23 mm.

In Comparative Example 30, since the Mn content was 1.05% that is more than the upper limit, delamination had occurred, after wire drawing was performed such that a wire diameter was 0.25 mm.

In Comparative Example 31, since the Al content was 0.012% that is more than the upper limit, delamination had occurred, after wire drawing was performed such that a wire diameter was 0.21 mm.

In Comparative Example 32, since the N content was 0.0055% that is more than the upper limit, delamination had occurred, after wire drawing was performed such that a wire diameter was 0.18 mm.

In Comparative Example 33, the thickness of the surface part was 43 μm that is less than the lower limit and the ratio between the lamellar cementite thicknesses reached 96% that is a value more than 95%. As a result, delamination had occurred, after wire drawing was performed such that a wire diameter was 0.21 mm.

In Comparative Example 34, since the thickness of the surface part was 1125 μm that is more than the upper limit, the tensile strength of the wire rod was 1060 MPa that is a value less than 1100 MPa. As a result, the tensile strength was 3105 MPa that is a value less than 3200 MPa, after wire drawing was performed such that a wire diameter was 0.21 mm.

Example 2

In a case where one or two or more of Ti: more than 0% and 0.1000% or less, Cr: more than 0% and 0.5000% or less, Co: more than 0% and 0.5000% or less, V: more than 0% and 0.5000% or less, Cu: more than 0% and 0.2000% or less, Nb: more than 0% and 0.1000% or less, Mo: more than 0% and 0.2000% or less, W: more than 0% and 0.200% or less, B: more than 0% and 0.0030% or less, REM: more than 0% and 0.0050% or less, Ca: more than 0.0005% and 0.0050% or less, Mg: more than 0.0005% and 0.0050% or less, and Zr: more than 0.0005% and 0.0100% or less are further included in the chemical composition by mass %, the effects of the present invention will be described using Examples of the present invention and Comparative Examples.

In Table 3, the chemical compositions of Examples of the present invention and Comparative Examples are shown.

Regarding the Al composition in Table 3, the description "---" indicates that the Al content is less than the limit of detection of Al.

In Table 3, in the chemical composition other than Al, the description "---" indicates that the corresponding element is not contained.

[Table 3]

TABLE 3

| | | CHEMICAL COMPOSITION (mass %) | | | | | | | | |
|---|---|---|---|---|---|---|---|---|---|---|
| TYPE | No. | C | Si | Mn | Al | N | Ti | Cr | Mo | Cu |
| EXAMPLES | 35 | 0.72 | 0.16 | 0.11 | 0.006 | 0.0025 | — | 0.49 | — | — |
| OF | 36 | 0.71 | 0.17 | 0.79 | — | 0.0011 | 0.030 | 0.01 | — | — |
| PRESENT | 37 | 0.71 | 0.16 | 0.99 | — | 0.0028 | 0.096 | 0.05 | 0.19 | — |
| INVENTION | 38 | 0.73 | 0.31 | 0.12 | — | 0.0026 | 0.006 | — | — | 0.05 |
| | 39 | 0.71 | 0.30 | 0.79 | — | 0.0035 | 0.012 | 0.19 | 0.05 | — |
| | 40 | 0.72 | 0.32 | 0.99 | 0.006 | 0.0048 | — | 0.20 | — | — |
| | 41 | 0.71 | 0.59 | 0.11 | — | 0.0034 | 0.050 | 0.49 | — | 0.12 |
| | 42 | 0.71 | 0.58 | 0.79 | 0.009 | 0.0031 | — | 0.18 | — | — |
| | 43 | 0.71 | 0.59 | 0.98 | 0.001 | 0.0031 | — | — | 0.19 | — |
| | 44 | 0.82 | 0.17 | 0.99 | — | 0.0028 | 0.032 | — | — | — |
| | 45 | 0.81 | 0.31 | 0.12 | — | 0.0026 | 0.006 | 0.19 | — | 0.19 |
| | 46 | 0.80 | 0.58 | 0.79 | — | 0.0035 | 0.012 | 0.20 | 0.05 | — |
| | 47 | 0.88 | 0.59 | 0.12 | 0.001 | 0.0034 | 0.015 | 0.19 | — | — |
| | 48 | 0.89 | 0.34 | 0.98 | 0.003 | 0.0031 | 0.032 | 0.20 | — | — |
| | 49 | 0.90 | 0.17 | 0.78 | — | 0.0031 | — | — | — | 0.05 |

TABLE 3-continued

| | | | | | | | | | | |
|---|---|---|---|---|---|---|---|---|---|---|
| | 50 | 0.99 | 0.30 | 0.98 | — | 0.0028 | 0.006 | 0.35 | 0.19 | — |
| | 51 | 0.98 | 0.59 | 0.12 | — | 0.0026 | 0.012 | — | — | — |
| | 52 | 1.00 | 0.17 | 0.99 | 0.003 | 0.0035 | — | 0.20 | — | — |
| | 53 | 1.09 | 0.17 | 0.98 | 0.001 | 0.0034 | 0.006 | 0.19 | 0.05 | — |
| | 54 | 1.07 | 0.31 | 0.12 | — | 0.0031 | 0.015 | 0.32 | — | — |
| | 55 | 1.09 | 0.59 | 0.79 | — | 0.0031 | 0.032 | — | — | 0.19 |
| | 56 | 1.19 | 0.16 | 0.12 | 0.003 | 0.0031 | — | 0.19 | — | |
| | 57 | 1.18 | 0.30 | 0.79 | — | 0.0028 | — | 0.20 | — | — |
| | 58 | 1.19 | 0.59 | 0.98 | 0.002 | 0.0026 | — | — | 0.19 | — |
| COMPAR- | 59 | 0.68 | 0.16 | 0.12 | 0.005 | 0.0031 | — | 0.19 | — | |
| ATIVE | 60 | 1.23 | 0.30 | 0.79 | — | 0.0028 | — | 0.20 | — | — |
| EXAMPLES | 61 | 0.80 | 0.12 | 0.12 | — | 0.0026 | 0.006 | 0.19 | — | 0.19 |
| | 62 | 0.72 | 0.65 | 0.13 | — | 0.0035 | 0.012 | 0.19 | 0.05 | — |
| | 63 | 0.81 | 0.17 | 0.09 | — | 0.0035 | — | 0.20 | — | — |
| | 64 | 0.89 | 0.39 | 1.05 | 0.006 | 0.0048 | 0.032 | 0.36 | 0.21 | — |
| | 65 | 0.82 | 0.29 | 0.12 | 0.012 | 0.0036 | 0.050 | 0.05 | — | 0.20 |
| | 66 | 0.79 | 0.25 | 0.35 | — | 0.0055 | — | 0.54 | 0.35 | 0.03 |
| | 67 | 0.89 | 0.39 | 0.46 | 0.003 | 0.0031 | — | 0.20 | — | — |
| | 68 | 0.82 | 0.29 | 0.12 | 0.005 | 0.0031 | — | 0.19 | — | — |

| | | CHEMICAL COMPOSITION (mass %) | | | | | | | | |
|---|---|---|---|---|---|---|---|---|---|---|
| TYPE | No. | V | Co | W | Nb | B | Mg | Ca | REM | Zr |
| EXAMPLES | 35 | — | 0.05 | — | — | — | — | — | — | — |
| OF | 36 | 0.05 | — | — | — | 0.0025 | — | — | — | — |
| PRESENT | 37 | — | — | — | — | — | — | — | — | — |
| INVENTION | 38 | — | — | 0.19 | — | — | — | — | — | — |
| | 39 | — | 0.13 | — | — | 0.0010 | — | — | — | — |
| | 40 | 0.12 | — | — | — | — | — | — | — | — |
| | 41 | — | — | — | — | — | — | — | 0.0029 | — |
| | 42 | — | 0.49 | — | 0.090 | 0.0010 | — | 0.0029 | — | — |
| | 43 | — | — | — | — | — | 0.0029 | — | — | — |
| | 44 | — | — | 0.070 | — | — | — | — | — | 0.0005 |
| | 45 | — | — | — | — | 0.0010 | — | — | — | — |
| | 46 | — | — | — | — | — | — | — | 0.0049 | — |
| | 47 | — | — | — | — | — | — | 0.0049 | — | — |
| | 48 | 0.49 | — | — | — | — | 0.0049 | — | — | — |
| | 49 | — | — | — | — | 0.0007 | — | — | — | 0.0009 |
| | 50 | — | — | — | — | — | — | — | — | — |
| | 51 | — | 0.12 | — | — | — | — | — | — | — |
| | 52 | 0.05 | — | — | — | — | — | — | — | — |
| | 53 | — | — | — | — | 0.0007 | — | — | — | — |
| | 54 | — | — | — | 0.020 | — | — | — | — | — |
| | 55 | — | — | 0.070 | — | — | — | — | — | — |
| | 56 | — | — | — | — | — | — | — | — | — |
| | 57 | 0.07 | — | — | — | — | — | — | — | — |
| | 58 | — | — | — | — | — | — | — | — | — |
| COMPAR- | 59 | — | — | — | — | — | — | — | — | — |
| ATIVE | 60 | 0.07 | — | — | — | — | — | — | — | — |
| EXAMPLES | 61 | — | — | — | — | 0.0010 | — | — | — | 0.0021 |
| | 62 | — | 0.13 | — | — | 0.0010 | — | — | 0.0027 | — |
| | 63 | 0.12 | — | — | — | — | — | 0.0031 | — | — |
| | 64 | — | — | — | — | — | 0.0038 | — | — | — |
| | 65 | 0.05 | — | — | 0.010 | 0.0340 | — | — | — | — |
| | 66 | — | — | — | — | — | — | — | — | — |
| | 67 | 0.07 | — | — | — | — | — | — | — | — |
| | 68 | 0.07 | — | — | — | — | — | — | — | — |

Wire rods for a high strength steel cord of Examples 35 to 58 of the present invention and Comparative Examples 59 to 68 were produced by the methods described in the hot rolling process S01 and the in-line heat treatment process S02.

In addition, the tensile strength TS was obtained by a tensile test based on "Method of tensile test for metallic materials" in JIS Z 2241.

[Table 4]

TABLE 4

| | | EVALUATION OF CHARACTERISTICS OF WIREROD | | | | | EVALUATION OF CHARACTERISTICS OF STEEL WIRE AFTER WIRE DRAWING | | | |
|---|---|---|---|---|---|---|---|---|---|---|
| TYPE | No. | CENTER PEARLITE AREA FRACTION (%) | WIRE DIA-METER (mm) | THICK-NESS OF SURFACE PART (μm) | RATIO BETWEEN LAMELLAR CEMENTITE THICKNESSES (%) | TENSILE STRENGTH TS (MPa) | WIRE DIAMETER AFTER WIRE DRAWING (mm) | OCCUR-RENCE OF DELAM-INATION | TENSILE STRENGTH TS (MPa) | COM-PRE-HENSIVE EVALU-ATION |
| EXAM- | 35 | 97 | 5.5 | 990 | 73 | 1150 | 0.15 | ABSENT | 3723 | G |
| PLES | 36 | 98 | 5.5 | 935 | 74 | 1234 | 0.18 | ABSENT | 3837 | G |
| OF | 37 | 99 | 3.5 | 350 | 83 | 1187 | 0.20 | ABSENT | 3756 | G |
| PRE- | 38 | 96 | 4.0 | 200 | 89 | 1192 | 0.30 | ABSENT | 3780 | G |
| SENT | 39 | 98 | 5.5 | 165 | 91 | 1212 | 0.35 | ABSENT | 3823 | G |
| INVEN- | 40 | 99 | 5.5 | 55 | 94 | 1308 | 0.15 | ABSENT | 3734 | G |
| TION | 41 | 98 | 5.5 | 495 | 84 | 1242 | 0.18 | ABSENT | 3779 | G |
| | 42 | 97 | 5.5 | 55 | 94 | 1154 | 0.20 | ABSENT | 3733 | G |
| | 43 | 98 | 5.5 | 990 | 73 | 1275 | 0.30 | ABSENT | 3747 | G |
| | 44 | 99 | 5.5 | 979 | 73 | 1242 | 0.35 | ABSENT | 4023 | G |
| | 45 | 96 | 5.5 | 483 | 84 | 1272 | 0.15 | ABSENT | 4013 | G |
| | 46 | 99 | 5.5 | 935 | 74 | 1446 | 0.18 | ABSENT | 4014 | G |
| | 47 | 98 | 3.5 | 683 | 71 | 1443 | 0.20 | ABSENT | 4217 | G |
| | 48 | 99 | 8.0 | 720 | 84 | 1482 | 0.30 | ABSENT | 4224 | G |
| | 49 | 98 | 5.5 | 499 | 84 | 1466 | 0.35 | ABSENT | 4237 | G |
| | 50 | 99 | 5.5 | 963 | 73 | 1488 | 0.15 | ABSENT | 4345 | G |
| | 51 | 99 | 7.0 | 645 | 83 | 1488 | 0.18 | ABSENT | 4323 | G |
| | 52 | 98 | 5.5 | 842 | 76 | 1512 | 0.20 | ABSENT | 4307 | G |
| | 53 | 97 | 4.0 | 374 | 83 | 1530 | 0.30 | ABSENT | 4534 | G |
| | 54 | 98 | 5.5 | 519 | 83 | 1580 | 0.35 | ABSENT | 4557 | G |
| | 55 | 97 | 5.5 | 891 | 75 | 1590 | 0.15 | ABSENT | 4569 | G |
| | 56 | 99 | 5.5 | 526 | 83 | 1623 | 0.18 | ABSENT | 4767 | G |
| | 57 | 98 | 5.0 | 660 | 79 | 1650 | 0.20 | ABSENT | 4800 | G |
| | 58 | 97 | 5.5 | 611 | 81 | 1100 | 0.30 | ABSENT | 4801 | G |
| COM- | 59 | 94 | 5.5 | 979 | 73 | 1080 | 0.30 | ABSENT | 3156 | B |
| PAR- | 60 | 98 | 5.5 | 483 | 84 | 1650 | 0.18 | PRESENT | 4792 | B |
| ATIVE | 61 | 97 | 5.5 | 935 | 74 | 1095 | 0.20 | ABSENT | 3166 | B |
| EXAM- | 62 | 96 | 5.5 | 1073 | 71 | 1281 | 0.20 | PRESENT | 4003 | B |
| PLES | 63 | 96 | 5.5 | 495 | 84 | 1397 | 0.23 | PRESENT | 4014 | B |
| | 64 | 97 | 5.5 | 499 | 84 | 1275 | 0.25 | PRESENT | 4034 | B |
| | 65 | 96 | 5.5 | 963 | 73 | 1275 | 0.21 | PRESENT | 4015 | B |
| | 66 | 98 | 5.5 | 507 | 83 | 1165 | 0.18 | PRESENT | 3901 | B |
| | 67 | 97 | 5.5 | 45 | 96 | 1278 | 0.21 | PRESENT | 3987 | B |
| | 68 | 96 | 5.5 | 1128 | 69 | 1070 | 0.20 | ABSENT | 3125 | B |

For the obtained wire rod for a high strength steel cord, the center pearlite area fraction (%), the wire diameter R (mm), the thickness (μm) of the surface part, the ratio (%) between the lamellar cementite thicknesses of the surface part and the central part, the tensile strength (MPa), the presence or absence of delamination after finish drawing, and the tensile strength were evaluated.

During the finish drawing, wet drawing was performed on the steel wire for a high strength steel cord subjected to the brass plating to achieve a wire diameter of 0.15 mm to 0.35 mm.

In addition, the presence or absence of delamination was determined by conducting a torsion test on the steel wire. In a case where a torsion test is conducted on the steel wire in which delamination occurs, a fracture surface generated due to torsional fracture is not a shear fracture surface but a fractured surface generated along longitudinal cracks. Therefore, the presence or absence of delamination can be determined by visually determining the fractured shape of the steel wire formed due to torsional fracture.

The evaluation results are shown in Table 4.

In Examples 35 to 58 of the present invention, the tensile strength of the wire rod was 1100 MPa or more, the delamination phenomenon had not occurred after the wire drawing was performed so that the wire diameter was 0.15 mm to 0.35 mm, and the tensile strength thereof was 3200 MPa or more, and therefore, the comprehensive evaluation was graded as good (G).

The comprehensive evaluation of Comparative Examples 59 to 68 was graded as bad (B). Hereinafter, the reason that the comprehensive evaluation of Comparative Examples 59 to 68 was graded as bad (B) will be described.

In Comparative Example 59, since the C content was 0.68% that is less than the lower limit, the center pearlite area fraction of the wire rod was 94% that is less than the lower limit and the tensile strength of the wire rod was 1080 MPa that is a value less than 1100 MPa. As a result, the tensile strength was 3156 MPa that is a value less than 3200 MPa, after wire drawing was performed such that a wire diameter was 0.30 mm.

In Comparative Example 60, since the C content was 1.23% that is more than the upper limit, the tensile strength of the wire rod was 1650 MPa. However, delamination had occurred, after wire drawing was performed such that a wire diameter was 0.18 mm.

In Comparative Example 61, since the Si content was 0.12% that is less than the lower limit, the tensile strength of the wire rod was 1095 MPa that is a value less than 1100 MPa. As a result, the tensile strength was 3166 MPa that is a value less than 3200 MPa, after wire drawing was performed such that a wire diameter was 0.20 mm.

In Comparative Example 62, since the Si content was 0.65% that is more than the upper limit, delamination had occurred, after wire drawing was performed such that a wire diameter was 0.20 mm.

In Comparative Example 63, since the Mn content was 0.09% that is less than the lower limit, delamination had occurred, after wire drawing was performed such that a wire diameter was 0.23 mm.

In Comparative Example 64, since the Mn content was 1.05% that is more than the upper limit, delamination had occurred, after wire drawing was performed such that a wire diameter was 0.25 mm.

In Comparative Example 65, since the Al content was 0.012% that is more than the upper limit, delamination had occurred, after wire drawing was performed such that a wire diameter was 0.21 mm.

In Comparative Example 66, since the N content was 0.0055% that is more than the upper limit, the ratio between the lamellar cementite thicknesses reached 96% that is a value more than 95%. As a result, delamination had occurred, after wire drawing was performed such that a wire diameter was 0.18 mm.

In Comparative Example 67, since the thickness of the surface part was 45 μm that is less than the lower limit, delamination had occurred, after wire drawing was performed such that a wire diameter was 0.21 mm.

In Comparative Example 68, since the thickness of the surface part was 1128 μm that is more than the upper limit, the tensile strength of the wire rod was 1070 MPa that is a value less than 1100 MPa. As a result, the tensile strength was 3125 MPa that is a value less than 3200 MPa, after wire drawing was performed such that a wire diameter was 0.21 mm.

INDUSTRIAL APPLICABILITY

The wire rod for a high strength steel cord of the present invention can be used to produce a filament for steel cord and a steel cord.

BRIEF DESCRIPTION OF THE REFERENCE SYMBOLS

20: WIRE ROD FOR HIGH STRENGTH STEEL CORD
21: SURFACE PART
22: CENTRAL PART
25: MEASUREMENT POINT OF SURFACE PART
26: MEASUREMENT POINT OF CENTRAL PART

What is claimed is:

1. A wire rod for a high strength steel cord, which has a wire diameter R of 3.5 mm to 8.0 mm, comprising, in a chemical composition, by mass %:

C: 0.70% to 1.20%;
Si: 0.15% to 0.60%;
Mn: 0.10% to 1.00%;
N: 0.0010% to 0.0050%;
Al: more than 0% and 0.0100% or less; and
a remainder of Fe and impurities,
wherein a surface part and a central part are included, the surface part covers the central part,
a thickness of the surface part is 50 μm to 0.20×R,
the central part includes a pearlite structure in a proportion of 95% to 100% by area %,
a C content of the surface part is 40% to 95% of a C content of the central part, and
a ratio of a thickness of a lamellar cementite at a center of the thickness of the surface part to a thickness of a lamellar cementite in the central part is 50 to 95%.

2. The wire rod for a high strength steel cord according to claim 1, further comprising, in the chemical composition, by mass %, one or two or more of
Ti: more than 0% and 0.1000% or less,
Cr: more than 0% and 0.5000% or less,
Co: more than 0% and 0.5000% or less,
V: more than 0% and 0.5000% or less,
Cu: more than 0% and 0.2000% or less,
Nb: more than 0% and 0.1000% or less,
Mo: more than 0% and 0.2000% or less,
W: more than 0% and 0.200% or less,
B: more than 0% and 0.0030% or less,
REM: more than 0% and 0.0050% or less,
Ca: more than 0.0005% and 0.0050% or less,
Mg: more than 0.0005% and 0.0050% or less, and
Zr: more than 0.0005% and 0.0100% or less.

* * * * *